US006250833B1

(12) United States Patent
Perry et al.

(10) Patent No.: US 6,250,833 B1
(45) Date of Patent: Jun. 26, 2001

(54) SOAP-DISPENSING KITCHEN BRUSH

(75) Inventors: Marco C. Perry, Brooklyn; Kevin R. Lozeau, Ridge, both of NY (US)

(73) Assignee: General Housewares Corp., Elmira, NY (US)

( * ) Notice: Subject to any disclaimer, the term of this patent is extended or adjusted under 35 U.S.C. 154(b) by 0 days.

(21) Appl. No.: 09/484,171

(22) Filed: Jan. 17, 2000

(51) Int. Cl.[7] ..... A46B 11/04

(52) U.S. Cl. ..... 401/278; 401/6; 401/206; 401/207; 401/290

(58) Field of Search ..... 401/279, 290, 401/140, 207, 6, 205, 206, 270, 275, 278; 215/306

(56) References Cited

U.S. PATENT DOCUMENTS

| | | |
|---|---|---|
| Re. 33,860 | 3/1992 | Chen . |
| D. 310,601 | 9/1990 | Byriel . |
| D. 324,776 | 3/1992 | Griffin et al. . |
| D. 324,777 | 3/1992 | Vangen . |
| D. 334,665 | 4/1993 | Johnson . |
| 838,241 | 12/1906 | Conners . |
| 844,256 | 2/1907 | Curcio . |
| 893,635 | 7/1908 | Marquart . |
| 950,074 | 2/1910 | Miller . |
| 1,026,009 | 5/1912 | Watanabe . |
| 1,060,046 | 4/1913 | Wells . |
| 1,082,839 | 12/1913 | Wurfschmidt . |

(List continued on next page.)

FOREIGN PATENT DOCUMENTS

| | | |
|---|---|---|
| 1285109 | 6/1991 | (CA) . |
| 30853 | 10/1884 | (DE) . |
| 636705 | 9/1936 | (DE) . |
| 3700113 | 7/1988 | (DE) . |
| 9409553 U | 9/1994 | (DE) . |
| 3513730 | 8/1997 | (DE) . |
| 837282 | 2/1969 | (IT) . |
| 1160540 | 3/1982 | (IT) . |
| 1096514 | 8/1985 | (IT) . |
| 1137936 | 9/1986 | (IT) . |
| 1158186 | 2/1987 | (IT) . |
| 1159219 | 2/1987 | (IT) . |
| 216790 | 7/1989 | (IT) . |
| 1208479 | 8/1989 | (IT) . |
| 1227445 | 4/1991 | (IT) . |
| RM92U0222 | 10/1992 | (IT) . |
| 00226081 | 4/1997 | (IT) . |

OTHER PUBLICATIONS

Photographs of Rite–Aid Soap–Fillable Brush.
Drawing No. 1384 of OXO Scrubbing Brush (1995).
Copy of Packaging Card for Phoenixware Brush (1991).
Photograph of Kellogg Brush.
Photograph of Acme International Inc. Brush (1994).

*Primary Examiner*—David J. Walczak
*Assistant Examiner*—Peter deVore
(74) *Attorney, Agent, or Firm*—Seyfarth Shaw

(57) ABSTRACT

A fluid-dispensing kitchen brush has a body including a fluid reservoir and a handle, the reservoir being closed by an end plate which is ultrasonically welded to the body and is, in turn, latched to a bristle block by means of resilient fingers on the block engaging in notches on the plate. A second embodiment also has a resilient tab on the plate engaging in a recess in the block. Aligned holes through the plate and the block which provide communication between the reservoir and the bristles is openable and closeable by a plug biased closed by a leaf spring and openable by means of a lever having a post receivable in a fluid-filling aperture in the body adjacent to the handle. The aperture is closed by a hollow cap hingedly movable between open and closed positions and having a flexible and resilient dome which, in the closed position, covers the post and is depressible for actuating the lever. A frictional cushioning grip sleeve covers the handle and a portion of the cap hinge to secure the cap to the handle.

14 Claims, 8 Drawing Sheets

U.S. PATENT DOCUMENTS

| | | | | |
|---|---|---|---|---|
| 1,099,209 | | 6/1914 | Friedman . | |
| 1,138,772 | | 5/1915 | Matthews . | |
| 1,275,516 | | 8/1918 | Wren . | |
| 1,293,071 | | 2/1919 | Fopiano . | |
| 1,329,944 | | 2/1920 | Williams . | |
| 1,350,415 | | 8/1920 | Larouche . | |
| 1,372,308 | | 3/1921 | MacRae . | |
| 1,470,903 | | 10/1923 | Ahlering . | |
| 1,577,192 | | 3/1926 | Rapisardi . | |
| 1,596,358 | | 8/1926 | Jones . | |
| 1,676,601 | | 7/1928 | Cavanaugh . | |
| 1,690,757 | | 11/1928 | Steiner et al. . | |
| 1,763,832 | | 6/1930 | Taylor . | |
| 1,810,544 | | 6/1931 | Trupiano . | |
| 1,862,430 | | 6/1932 | Robb . | |
| 1,927,788 | | 9/1933 | Larkin . | |
| 2,091,369 | | 8/1937 | LeMoine et al. . | |
| 2,103,493 | | 12/1937 | Robertson . | |
| 2,493,990 | | 1/1950 | Morgadanes et al. . | |
| 2,764,772 | | 10/1956 | Staskowski et al. . | |
| 2,793,382 | | 5/1957 | Fletcher . | |
| 2,795,000 | | 6/1957 | Lomholdt . | |
| 2,823,401 | | 2/1958 | O'Higgins . | |
| 2,908,926 | | 10/1959 | Jockers . | |
| 2,920,333 | | 1/1960 | Montague et al. . | |
| 2,952,026 | | 9/1960 | Pland . | |
| 3,788,753 | | 1/1974 | Stewart . | |
| 3,889,640 | * | 6/1975 | Restall | 119/75 |
| 4,066,367 | | 1/1978 | Sherosky . | |
| 4,124,316 | * | 11/1978 | O'Rourke | 401/184 |
| 4,229,116 | | 10/1980 | Moore . | |
| 4,236,651 | * | 12/1980 | Meyer et al. | 222/82 |
| 4,252,455 | | 2/1981 | de la Pena . | |
| 4,485,807 | | 12/1984 | Gueret . | |
| 4,534,483 | * | 8/1985 | Kassis et al. | 215/306 |
| 4,580,587 | | 4/1986 | Rittich et al. . | |
| 4,753,547 | | 6/1988 | Dodero . | |
| 4,775,256 | | 10/1988 | Roth . | |
| 4,826,340 | | 5/1989 | Rothweiler et al. . | |
| 4,832,060 | | 5/1989 | Kingsford . | |
| 4,861,180 | | 8/1989 | Adams . | |
| 4,893,957 | | 1/1990 | Byriel . | |
| 4,895,468 | | 1/1990 | Chappell . | |
| 4,955,746 | * | 9/1990 | Craigmile | 401/131 |
| 4,966,484 | | 10/1990 | Kimura . | |
| 5,017,036 | | 5/1991 | Vidovic . | |
| 5,088,849 | | 2/1992 | Johnson et al. . | |
| 5,103,560 | | 4/1992 | Podolsky . | |
| 5,114,255 | | 5/1992 | Villarreal . | |
| 5,133,130 | | 7/1992 | Podolsky . | |
| 5,158,383 | | 10/1992 | Glover et al. . | |
| 5,251,752 | | 10/1993 | Purohit . | |
| 5,313,682 | | 5/1994 | Chamieh . | |
| 5,346,324 | | 9/1994 | Kuo . | |
| 5,397,194 | | 3/1995 | Yuan et al. . | |
| 5,673,455 | * | 10/1997 | Per-Lee et al. | 15/210.1 |
| 5,827,001 | | 10/1998 | Taghavi-Khanghah . | |
| 5,890,829 | | 4/1999 | Hesse . | |
| 5,934,296 | * | 8/1999 | Clay | 132/320 |

* cited by examiner

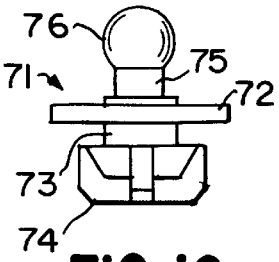
FIG. 16
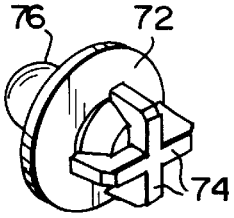
FIG. 18
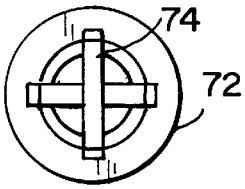
FIG. 17
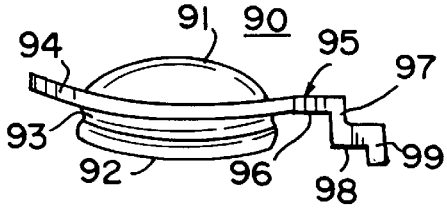
FIG. 6
FIG. 5
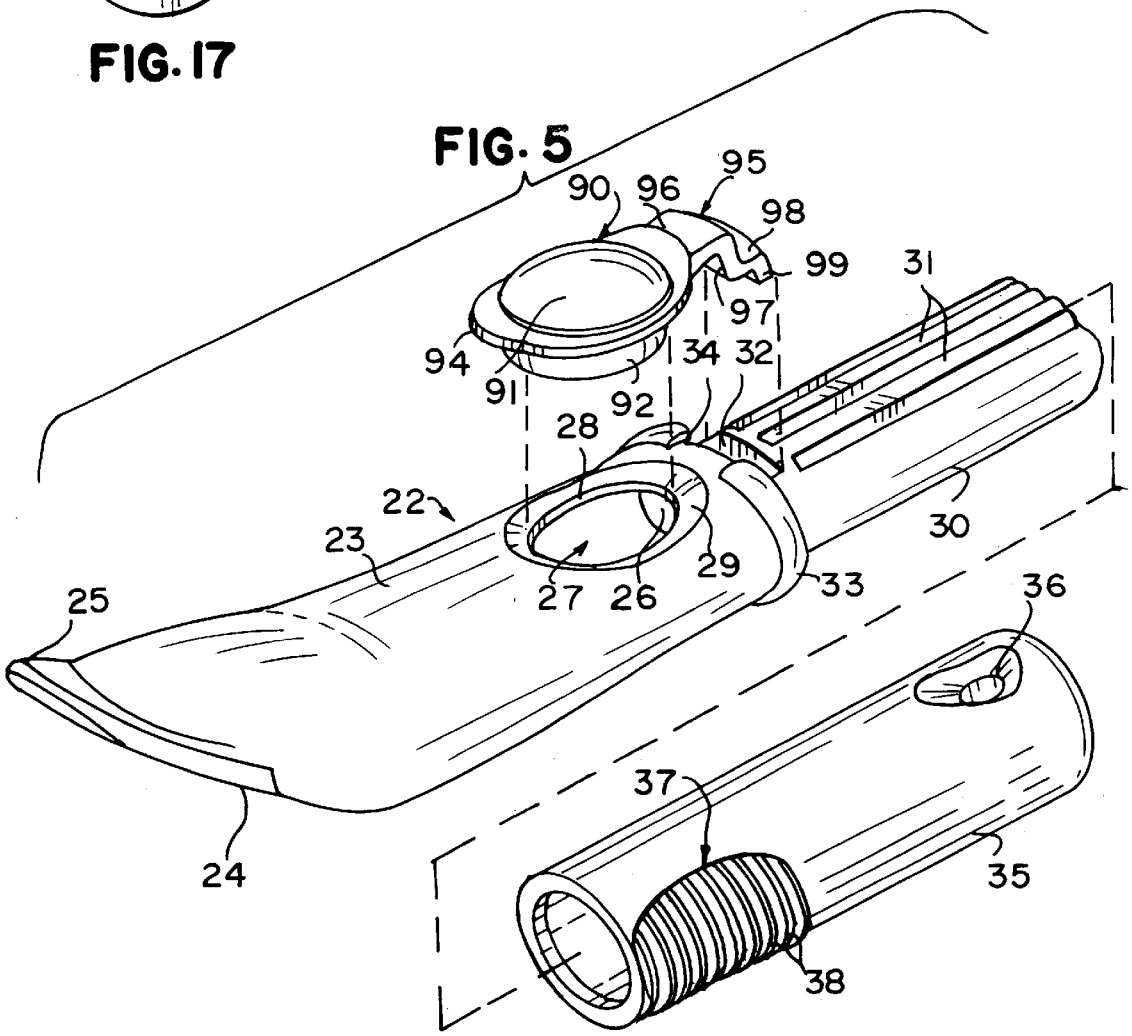

SOAP-DISPENSING KITCHEN BRUSH

BACKGROUND OF THE INVENTION

The present invention relates to fluid-dispensing implements or utensils, and in particular to household cleaning implements or utensils, such as brushes and the like. The invention has particular application to a kitchen brush which is capable of dispensing liquid soap or detergent.

Many fluid-dispensing brushes have heretofore been provided. Such brushes typically include a fluid reservoir, a closeable opening for filling the reservoir, and a manually actuated valve mechanism for dispensing fluid from the reservoir to the area of the brush bristles. However, such prior brushes have typically been characterized by either a relatively complex or expensive-to-manufacture construction and have typically provided reservoir filling and valve actuating mechanisms which are independent of each other.

SUMMARY OF THE INVENTION

It is a general object of the invention to provide an improved fluid-dispensing implement which avoids the disadvantages of prior such implements while affording additional structural and operating advantages.

An important feature of the invention is the provision of an implement of the type set forth, which combines the functions of valve actuation and opening and closing of a fluid reservoir port in a single-mechanism.

Another feature of the invention is the provision of an implement of the type set forth which affords a unique latching engagement between a work-engaging medium holder and an implement housing.

Another feature of the invention is the provision of an implement of the type set forth, which provides a valve assembly with a unique biasing mechanism.

Still another feature of the invention is the provision of an implement of the type set forth, which is of relatively simple and economical construction.

Certain ones of these and other features of the invention may be attained by providing a fluid-dispensing implement comprising: a body defining a fluid reservoir therein and having a handle thereon, a work-engaging medium carried by the body, a valve assembly carried by the body for providing communication between the reservoir and the medium and having an actuating member, the body having a fluid-filling aperture therein adjacent to the handle and receiving a portion of the actuating member, and a flexible and resilient hollow cap carried by the body for movement between open and closed positions relative to the aperture, the cap in its closed position receiving the portion of the actuating member and being manually deflectable to operate the actuating member.

Other features of the invention may be attained by providing the medium on a holder which is latchable to an implement housing.

Still further features of the invention may be afforded by providing an implement of the type set forth wherein the valve assembly includes a valve member biased by a leaf spring to a closed position.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 5 is an exploded perspective view of portions of the brush of FIG. 1;

FIG. 6 is a side elevational view of the cap of the brush of FIG. 1;

FIG. 16 is a side elevational view of the valve plug of the brush of FIG. 3;

FIG. 17 is a bottom plan view of the plug of FIG. 17;

FIG. 18 is a bottom perspective view of the plug of FIG. 16;

DESCRIPTION OF THE PREFERRED EMBODIMENT

Figure 1:
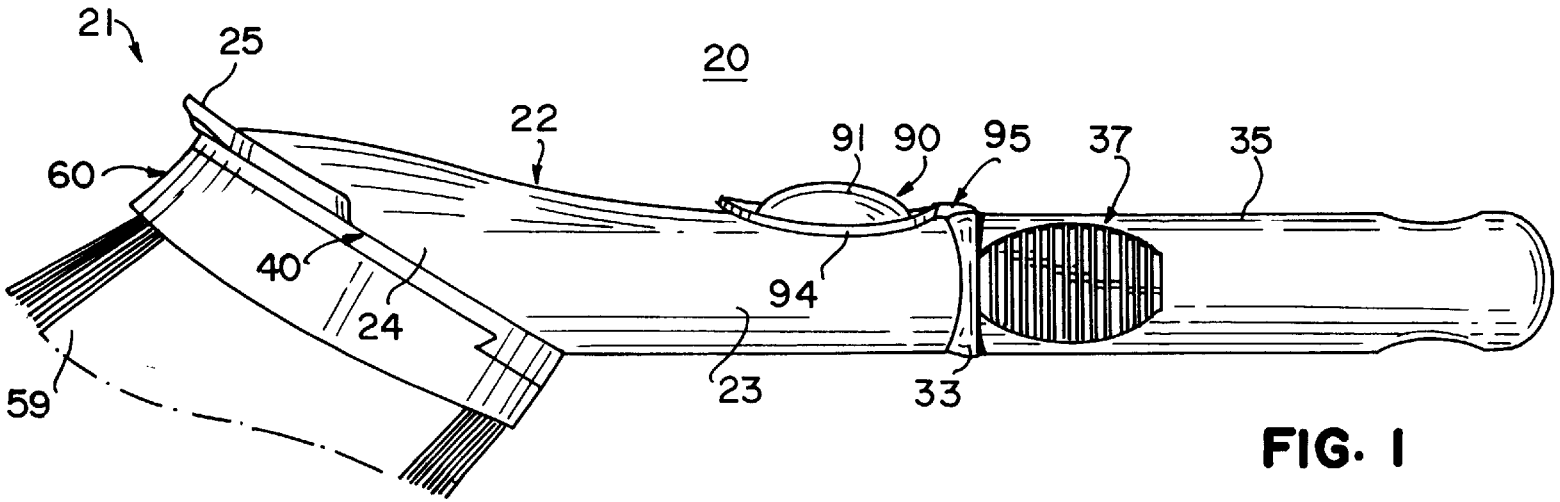
FIG. 1 is a side elevational view of a kitchen brush in accordance with the present invention.
Figure 2:
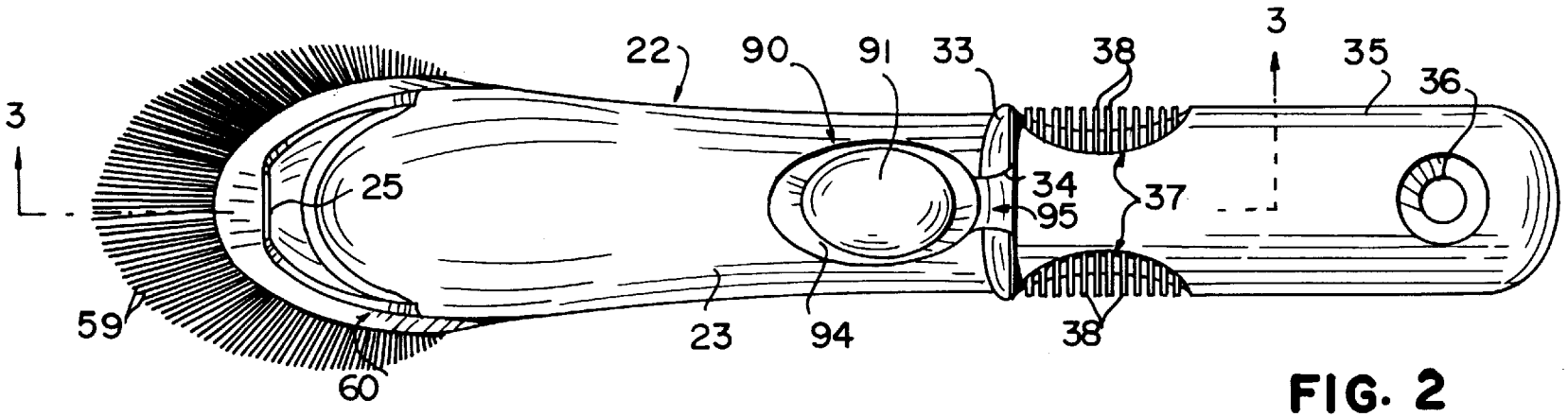
FIG. 2 is a top plan view of the brush of FIG. 1.
Figure 3:
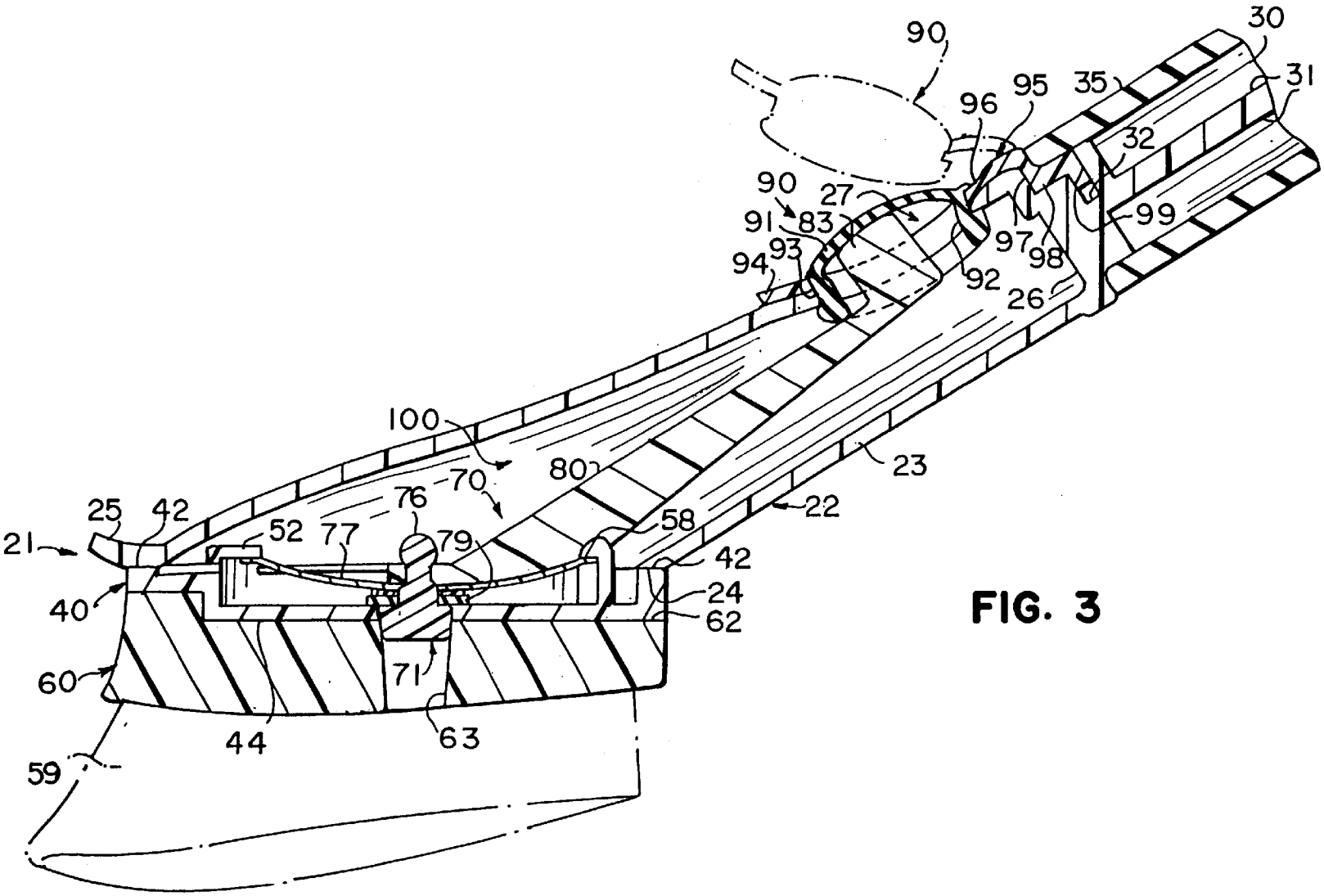
FIG. 3 is an enlarged, fragmentary, sectional view taken generally along the line 3—3 in FIG. 2.
Figure 4:
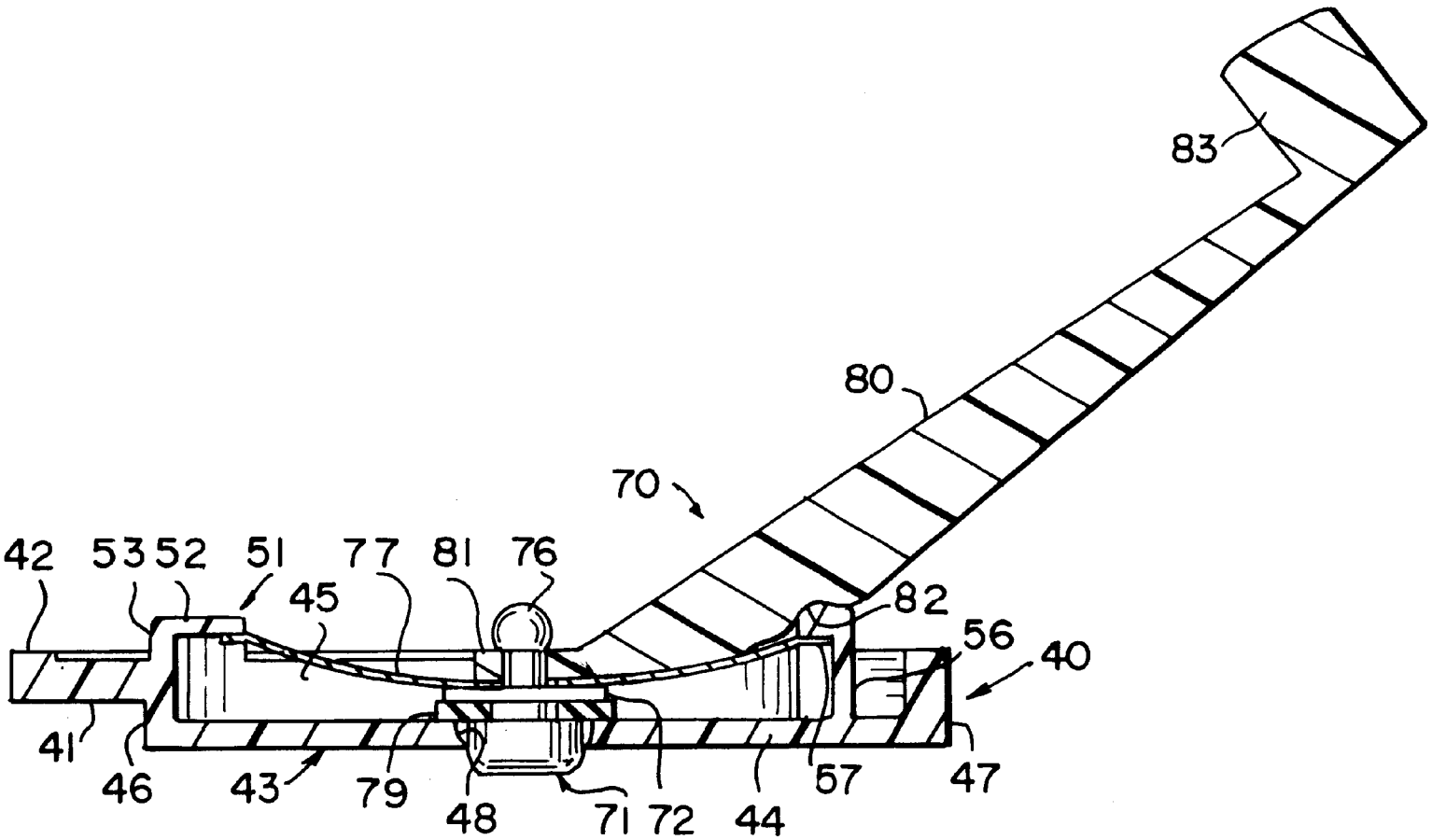
FIG. 4 is a further enlarged sectional view of the valve assembly of the brush of FIG. 3.
Figure 7:
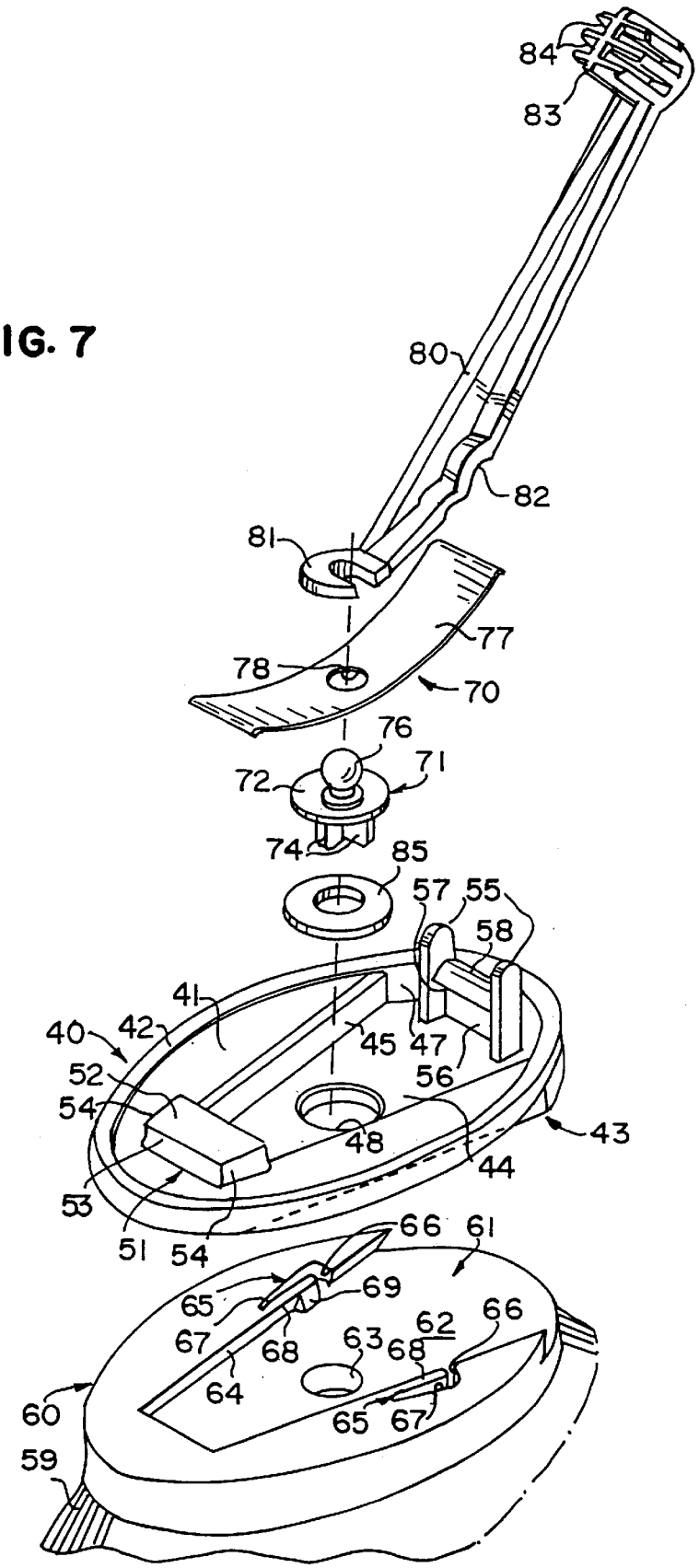
FIG. 7 is an exploded perspective view of other portions of the brush of FIG. 1.
Figure 8:
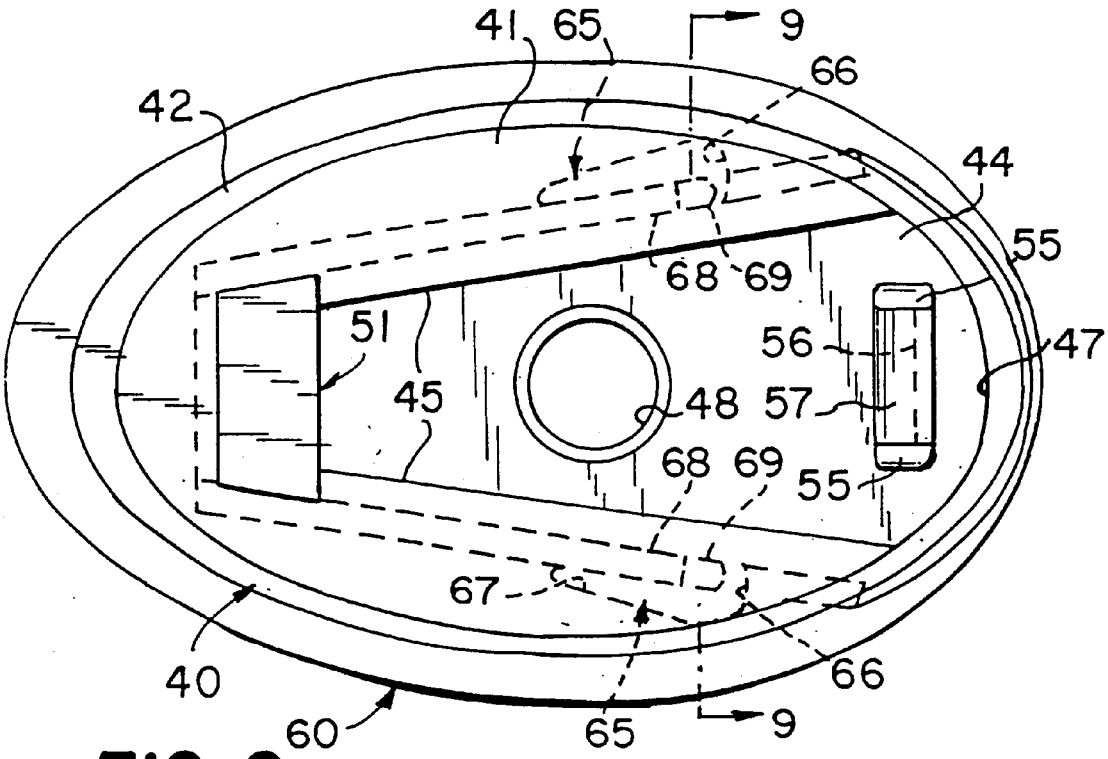
FIG. 8 is a further enlarged top plan view of the assembled end plate and bristle block of the brush of FIG. 1.
Figure 9:
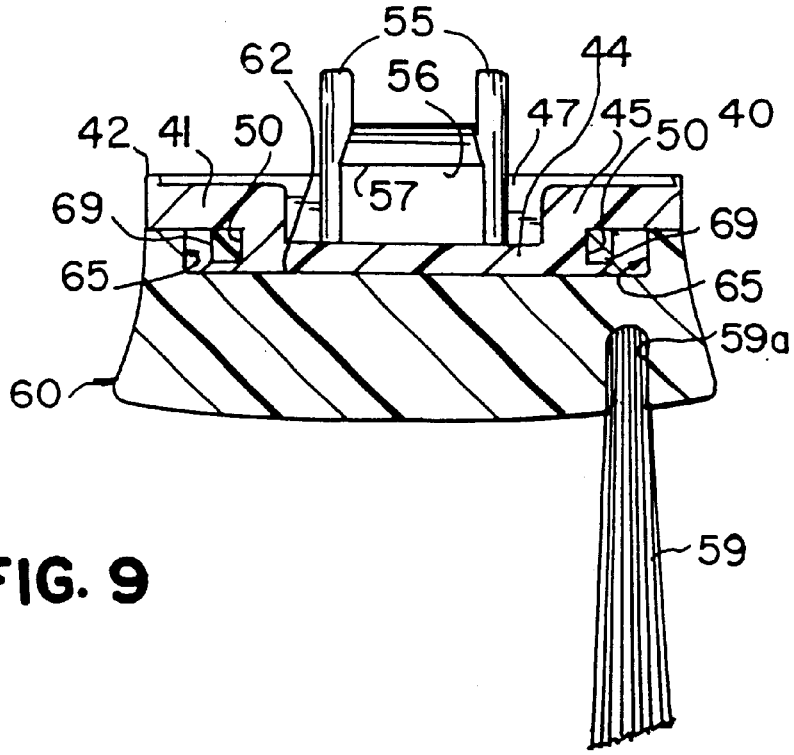
FIG. 9 is a view in vertical section taken along the line 9—9 in FIG. 8.

Referring to FIGS. 1 and 2, there is illustrated a fluid-dispensing implement in the nature of a kitchen brush 20, constructed in accordance with and embodying the features of the present invention. The brush 20 has a housing 21, which includes a body 22 with a hollow, tubular front portion 23 closed by an end plate 40, for cooperation therewith to define a fluid reservoir 100. Referring also to FIGS. 3 and 5, the hollow tubular front portion 23 flares outwardly forwardly, terminating in a wide front end 24, which is provided with a forwardly and upwardly projecting flange 25, which can be used as a scraper or the like. The narrow end of the tubular portion 23 is closed by an end wall 26 and is provided at its upper side with an oval aperture 27 adjacent to the end wall 26, the aperture 27 having an edge 28 and being provided with a shallow countersink 29.

Integral with the end wall 26 and projecting rearwardly therefrom is an elongated handle 30, generally oval in transverse cross section and provided with pairs of longitudinal slots 31 along the upper and lower sides thereof. Also formed in the upper side of the handle 30 adjacent to the end wall 26 is a rectangular recess 32. Formed at the junction between the handle 30 and the tubular front portion 23 is a laterally outwardly projecting rib 33, which extends peripherally about the body 22 except for a gap 34 adjacent to the aperture 27. The handle 30 is covered by a grip sleeve 35 formed of a suitable frictional and cushioning material. The sleeve 35 has a closed end which extends beyond the distal end of the handle 30 and has a through hole 36 therein to facilitate hanging the brush 20. The slots 31 in the handle 30 reduce the surface area thereof to facilitate sliding the sleeve 35 onto the handle 30, the sleeve 35 being secured in place by any suitable means. Formed in the opposite sides of the sleeve 35 are grip sites defined by generally saddle-shaped recesses 37, each recess 37 being provided with a plurality of laterally outwardly projecting, flexible and resilient ribs 38 to facilitate gripping by a user's thumb and forefinger, The grip sleeve 35 may be generally of the type disclosed in U.S. Pat. No. Re. 34,194, the disclosure of which is incorporated herein by reference.

Figure 10:
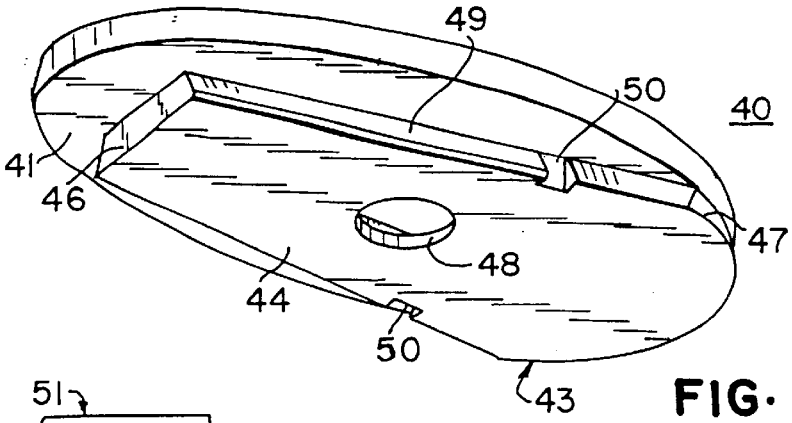
FIG. 10 is a bottom perspective view of the end plate of the brush of FIG. 1.
Figure 14:
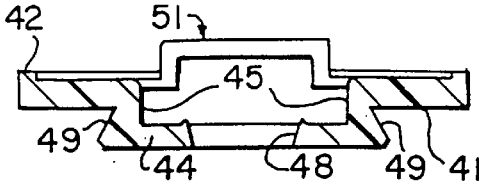
FIG. 14 is a view in vertical section taken generally along the line 14—14 in FIG. 11 and inverted.
Figure 13:
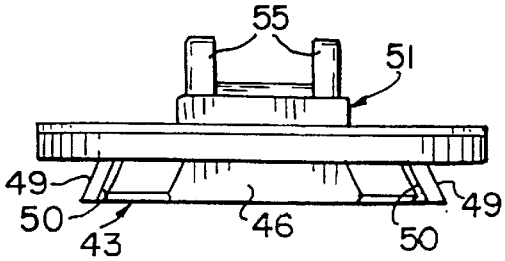
FIG. 13 is an end elevational view of the end plate of FIG. 12, as viewed from the left-end thereof.
Figure 15:
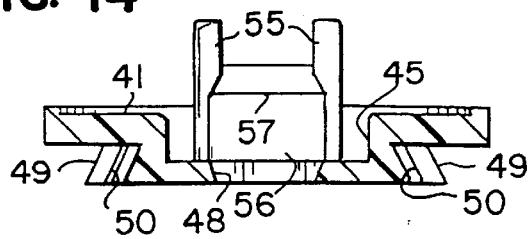
FIG. 15 is a view in vertical section taken generally along the line 15—15 in FIG. 11 and inverted.
Figure 11:
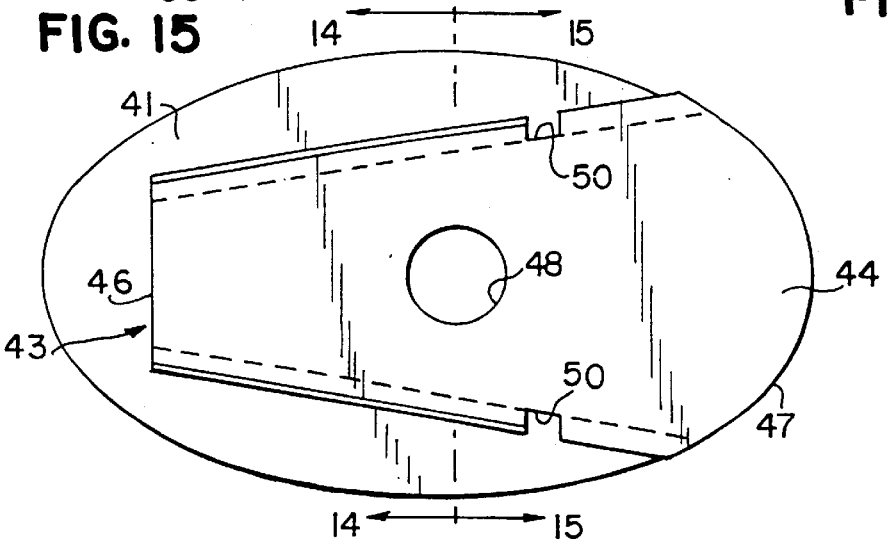
FIG. 11 is a bottom plan view of the end plate of FIG. 10.
Figure 12:
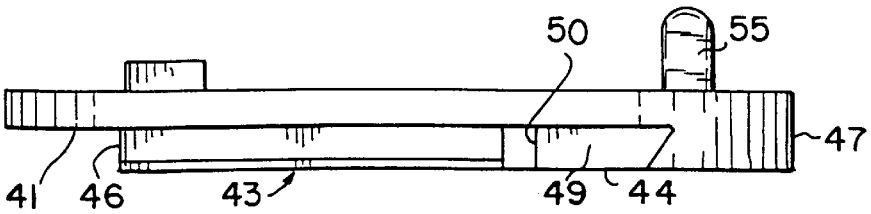
FIG. 12 is a side elevational view of the end plate of FIG. 11 as viewed from the upper side thereof.

Referring now also to FIGS. 7–15, the end plate 40 is preferably of unitary, one-piece construction and includes an oval base wall 41 having a peripheral raised rim 41 of substantially the same size and shape as the wide end 24 of the body 22. The base wall 41 has a large, generally wedge-shaped opening in one end thereof which extends most of the length thereof and is closed by a depending coupling structure 43. The coupling structure 43 has a flat bottom wall 44 parallel with the base wall 41 and joined thereto by a pair of converging side walls 45, a narrow end wall 46 and a wide end wall 47 which is arcuate in shape and generally follows the contour of the base wall oval. Formed generally centrally through the bottom wall 44 is a frustoconical aperture 48 with its wide end disposed at the upper surface of the bottom wall 44. Each of the side and end walls 45–47 has an inner surface which is substantially perpendicular to the bottom wall 44. However, the converging side walls 45 have outer surfaces 49 which slope downwardly and laterally outwardly, as can best be seen in FIGS. 10 and 13–15. Thus, it will be appreciated that the outer surface of the narrow end wall 46 is substantially trapezoidal in shape, as is best shown in FIG. 10. Respectively formed in the outer surfaces 49 rearwardly of the aperture 48 are notches 50 for a purpose to be explained more fully below.

The end plate 40 is also provided with a hood 51 upstanding from the upper surface of the base wall 41 at the narrow end of the coupling structure 43. The hood 51 has a rectangular top wall 52 substantially parallel to the base wall 41 and spaced thereabove by a rectangular end wall 53 and converging rectangular side walls 54, the walls 53 and 54 all being substantially perpendicular to the base wall 41. Upstanding from the upper surface of the bottom wall 44 are a pair of posts 55 which project upwardly above the rim 42 and are joined by a rectangular wall 56 which is shorter than the posts 55 and is provided at its upper end with a forwardly projecting flange 57 having a convex upper surface 58. In assembly, the rim 42 of the end plate 40 is fixedly secured to the wide end 24 of the body 22, as by ultrasonic welding, to form a brush housing and for cooperation with the tubular front portion 23 of the body 22 to form the reservoir 100.

The brush 20 has a plurality of bristles 59, which are preferably arranged in groups respectively mounted in sockets 59*a* (one shown in FIG. 9) in a bristle block 60, all in a well known manner. The bristle block 60 has an oval shape sized for mating with the end plate 40. The bristle block 60 has a generally wedge-shaped recess 61 formed in the upper surface thereof sized for mating with the coupling structure 43 of the end plate 40, and extending from the rear end of the bristle block 60 longitudinally forwardly to a narrow end adjacent to the forward end of the bristle block 60. The recess 61 has a flat bottom surface 62 in which is formed a frustoconical aperture 63, which extends to the bottom of the bristle block 60.

The recess 61 has converging, undercut side surfaces 64, which slope downwardly and laterally outwardly. Respectively formed in the side surfaces 64 rearwardly of the aperture 63 are generally L-shaped notches 65, each having a relatively wide short leg 66 which communicates with the recess 61 and a forwardly extending, tapered long leg 67 which extends generally parallel to the adjacent side surface 64 and cooperates therewith to define therebetween a finger 68. Each finger 68 is spaced a slight distance above the bottom surface 62 so as to define a thin, flexible and resilient member which can move laterally into the long leg 67 of the adjacent notch 65. Each finger 68 is provided at its distal end with a lug 69 which is not undercut, but rather has an inner side wall substantially perpendicular to the bottom surface 62.

In assembly, the wedge-shaped coupling structure 43 of the end plate 40 is slid longitudinally into the wedge-shaped recess 61 of the bristle block 60, so that the sloping side surfaces 49 of the end plate 40 provide a dovetail fit with the undercut side surfaces 64 of the bristle block 60. As the end plate 40 approaches its fully inserted position in the recess 61, the sloping side surfaces 49 are respectively brought into camming engagement with the vertical inner side surfaces of the lugs 69. The fingers 68 deflect laterally outwardly out of the way to permit continued passage of the coupling structure 43 of the end plate 40, until the lugs 69 respectively snap back into latching engagement in the notches 50 to firmly latch the end plate 40 and the bristle block 60 together in the latched configuration illustrated in FIGS. 3, 8 and 9. In this configuration, the apertures 48 and 63 are coaxially aligned with each other, as can best be seen in FIG. 3, and the outer peripheral surfaces of the end plate 40 and the bristle block 60 are substantially continuous with each other.

Referring now in particular to FIGS. 3, 4, 7 and 16–18, the brush 20 includes a valve assembly, generally designated by the numeral 70 mounted on the end plate 40. The valve assembly 70 includes a plug 71 having a circular main plate 72, from which depends a reduced-diameter hub 73, integral with four wings 74 in a cruciform arrangement. Upstanding from the plate 72 is a short cylindrical stem 75 integral at its upper end with a part-spherical knob 76. The wings 74 of the plug 71 are dimensioned to fit through the aperture 48 in the end plate 40 and into the upper end of the aperture 63 in the bristle block 60, as can best be seen in FIG. 3.

The valve assembly 70 also includes an elongated leaf spring 77 having a bowed at-rest configuration and provided with a circular hole 78 therethrough centrally thereof. The hole 78 is dimensioned so that the knob 76 can be snap-fitted therethrough, the leaf spring 77 having flat ends respectively receivable beneath the ledges defined by the hood top wall 52 the flange 57. An annular gasket 79 is snap-fitted over the wings 74 so as to be trapped around the hub 73 between the wings 74 in the plate 72. When the parts are thus assembled, the leaf spring 77 resiliently biases the plug 71 into the apertures 48 and 63 to a closed condition, illustrated in FIGS. 3 and 4, wherein the gasket 79 seals against the upper surface of the bottom wall 44 around the periphery of the aperture 48, thereby closing the valve and preventing the flow of fluid through the passage defined by the apertures 48 and 63.

The valve assembly 70 also includes an elongated lever arm 80 having a hook 81 formed at one end thereof and adapted to be snap-fitted around the stem 75 of the plug 71. The lever arm 80 is provided intermediate its ends with an arcuate bearing surface 82 formed in its lower surface and adapted for mateably receiving therein the arcuate upper surface 58 of the flange 57, which serves as a fulcrum for the lever. The lever arm 80 is provided at its opposite end with a post 83 which projects from the lever arm 80 generally perpendicular to its longitudinal axis and is in the form of a generally cylindrical body having a plurality of slots 84 formed in the opposite sides thereof (see FIG. 7). The lever arm 80 is shaped and dimensioned so that, in the at-rest condition of the valve assembly 70, illustrated in FIG. 3, the post 83 projects into and through the aperture 27 in the body 22.

Referring to FIGS. 3, 5 and 6, the brush 20 also includes a cap 90 having a flexible and resilient dome 91 integral along its peripheral edge with a substantially cylindrical side wall 92 which has an annular groove 93 formed in the outer surface thereof. The cap 90 also has a peripheral flange 94 which projects laterally outwardly from the upper end of the side wall 92 adjacent to the dome 91 and is integral at its rear end with a flexible and resilient hinge 95. The hinge 95 has a leg 96 which extends rearwardly through the gap 34 in the rib 33 and is integral at its rear end with a depending leg 97, which extends along the rear surface of the end wall 26 and is integral at its lower end with a leg 98, which extends rearwardly along the upper surface of the handle 30 and is integral at its rear end with a depending leg 99, which extends downwardly into the recess 32 in the handle 30. It will be appreciated that when the grip sleeve 35 is fitted in place over the handle 30 it covers the hinge leg 98 and abuts the hinge leg 97 for securely attaching the hinge 95 to the handle 30.

It will be appreciated that, in use, the cap 90 is pivotally movable about the hinge 95 between an upstanding position, shown in phantom in FIG. 3, opening the aperture 27 to permit filling of the reservoir 100, and a closed position shown in FIGS. 1 and 2 and in solid line in FIG. 3, for closing the aperture 27. In moving to the closed position, the lower end of the cylindrical side wall 92 snaps past the edge 28 of the aperture 27, which edge seats in the groove 93, with the peripheral flange 94 disposed in the aperture countersink 29. The forward end of the flange 94 provides a tab to facilitate lifting the cap 90 to its open position.

In operation, when it is desired to open the valve assembly 70, the flexible and resilient dome 91 of the cap 90 is depressed by the thumb of a user's hand wrapped around the handle grip sleeve 35. The parts are dimensioned so that, in the at rest condition illustrated in FIG. 3, the distal end of the post 83 contacts the inner surface of the dome 91, so that manual depression of the dome 91 depresses the post 83 and pivots the lever arm 80 about the fulcrum defined by the flange surface 58, for raising the plug 71, against the urging of the leaf spring 77, and opening the valve. When the valve is opened, fluid stored in the reservoir 100 may pass through the passage defined by the apertures 48 and 63 to the bristles 59. It will be appreciated that it is not necessary for the plug 71 to completely clear the aperture 48. Rather, as soon as the gasket 79 is unseated, fluid can flow therebeneath through the aperture 48, around the hub 73 and between the wings 74 of the plug 71.

In assembly, the cap hinge 95 is seated in place with its leg 99 in the handle recess 32, and then the grip sleeve 35 is installed over the handle 30 to lock the hinge 95 in place. The end plate 40 is latched together with the bristle block 60 in the manner described above and the valve assembly 70 is then assembled on the end plate 40, as described above. The end plate 40 is then fitted to the body 22, with the lever arm 80 fitted up inside the tubular portion 23 to the position illustrated in FIG. 3, whereupon the end plate 40 is ultrasonically welded to the body 22 in the manner described above. In this regard, all of the parts of the brush 20, with the exception of the leaf spring 77, are preferably formed of suitable moldable plastic materials compatible with liquid soap, although the grip sleeve 35 may be formed of a suitable elastomeric material, the gasket 79 may be formed of a rubber-like material, such as a Buna-N and the cap 90 may be formed of a rubber material such as Alcryn.

In the preferred embodiment, the utensil described is a brush, with a work-engaging medium in the form of bristles 59 fixed in a bristle block 60 which serves as a holder. However, it will be appreciated that the principles of the invention are applicable to other types of utensils wherein the work-engaging medium takes other forms, such as sponges or the like, in which case the bristle block 60 would be modified to a suitable type of holder for that medium. Furthermore, the principles of the invention are not limited to household utensils, but rather, the fluid-dispensing aspects of the invention are applicable to other types of implements and utensils.

Figure 19:
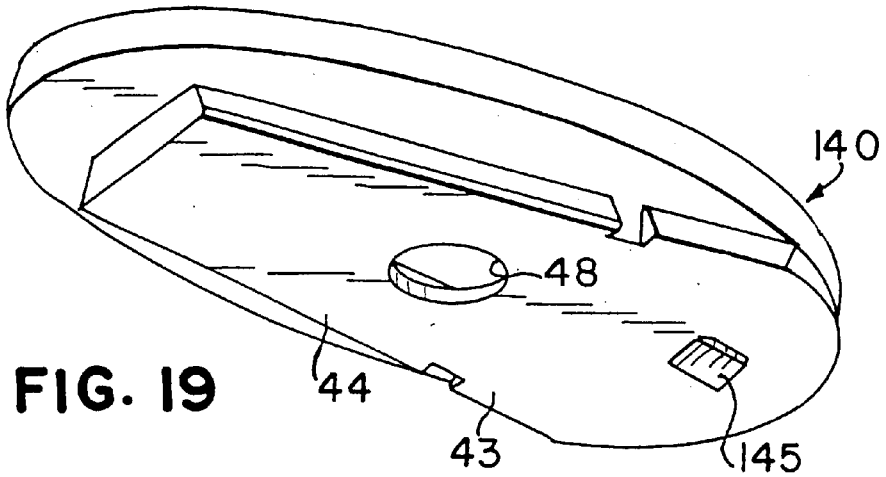
FIG. 19 is a view similar to FIG. 10 of an alternative embodiment of the end plate.
Figure 20:
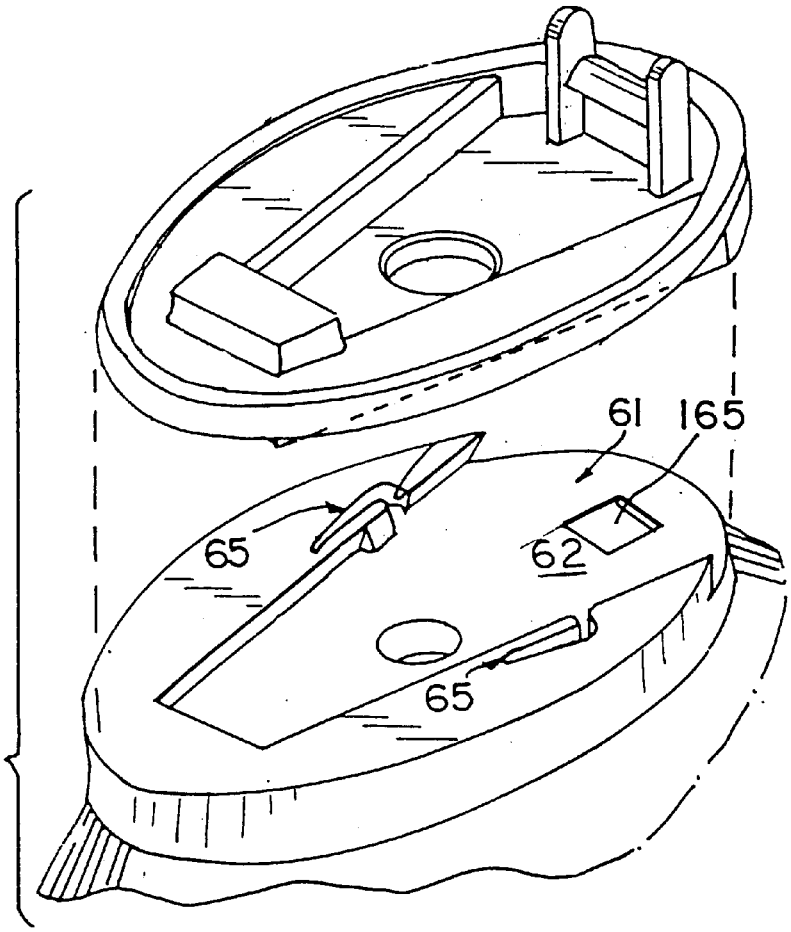
FIG. 20 is a perspective, exploded view of the end plate of FIG. 19 and a complementary bristle block.

Referring to FIGS. 19 and 20 there is illustrated an alternative arrangement of end plate and mating bristle block. More specifically, there is shown an end plate 140 which is substantially the same as the end plate 40, described above, wherefore like parts bear the same reference numbers. The end plate 140 differs from the end plate 40 in that it includes a flexible and resilient snap tab 145 unitary with the coupling structure 43 and extending downwardly and rearwardly therefrom at a shallow angle rearwardly of the aperture 48. Preferably, the snap tab 145 is rectangular in shape. Mateable with the end plate 140 is a bristle block 160, which is substantially the same as the bristle block 60, described above, wherefore like parts will bear the same reference numbers. The bristle block 160 differs from the bristle block 60 in that it includes a rectangular recess 165 formed in the bottom surface 62 centrally thereof and rearwardly of the notches 65 and shaped and dimensioned to be complementary to the snap tab 145. It will be appreciated that, in use, when the coupling structure 43 of the end plate 140 is slid into the recess 61 of the bristle block 160, when the snap tab 145 engages the rear end of the bristle block it will be folded flat up against the bottom wall 44 until, when the parts reach the fully inserted position, the snap tab 145 will snap down into the recess 165, so that the rear edge of the snap tab 145 engages the rear edge of the recess 165 to prevent separation of the parts from their latched condition. This embodiment provides a firmer latching engagement of the parts than the embodiment of FIGS. 1–18.

From the foregoing, it can be seen that there has been provided an improved fluid-dispensing implement which is of simple and economical construction and is characterized by ease of assembly and operation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A fluid-dispensing implement comprising:

a body defining a fluid reservoir therein and having a handle thereon, a work-engaging medium carried by the body, a valve assemble carried by the body for providing communication between the reservoir and the medium and having an actuating member, said body having a fluid-filling aperture therein adjacent to the handle end receiving a portion of said actuating member, a flexible and resilient hollow cap pivotally mounted on the body for movement between open and closed positions relative to the aperture, said cap in its closed position receiving said portion of the actuating member and being manually deflectable to operate said actuating member, the cap including a cup-like structure and a flexible and resilient hinge projecting laterally from said structure and unitary therewith, and a grip sleeve formed of a frictional cushioning material and covering said handle and a portion of said hinge for retaining said cap in place on said handle.

2. The implement of claim 1, wherein said actuating member includes a lever having at one end thereof a post disposed in said hollow cap.

3. The implement of claim 2, wherein said cap includes a flexible and resilient dome portion projecting laterally outwardly from said body in the closed position of said cap and covering said post and depressible by a user's thumb or finger to move said post and said lever.

4. The implement of claim 1, wherein said body has a rim defining said aperture, said cap having a generally cylindrical wall portion receivable in said aperture, said wall portion having a circumferential groove for receiving said rim in a snap fit therein.

5. A fluid-dispensing implement comprising:

a housing defining a fluid reservoir therein, said housing having a first latch structure thereon, a holder and a work-engaging medium held thereby, said holder having a second latch structure thereon adapted for latching engagement with said first latch structure securely to mount said holder on said housing, and a manually openable valve assembly carried by said housing and cooperating with said holder to provide communication between the reservoir and the medium, said holder having a wedge-shaped recess therein, said housing having a wedge-shaped projection thereon mateably receivable in said recess, said fingers being disposed adjacent to said recess and said notches being disposed on said projection.

6. The implement of claim 5, wherein said first latch structure includes a notch and said second latch structure includes a flexible and resilient finger receivable in said notch.

7. The implement of claim 5, wherein said first latch structure includes a pair of notches and said second latch structure includes a pair of flexible and resilient fingers respectively receivable in said notches.

8. The implement of claim 7, wherein said first latch structure includes a flexible and resilient tab and said second latch structure includes a recess for receiving said tab.

9. The implement of claim 5, wherein said projection and said recess respectively have mating dovetail shapes in transverse cross section.

10. The implement of claim 5, wherein said first latch structure includes a flexible and resilient tab and said second latch structure includes a recess for receiving said tab.

11. The implement of claim 5, and further comprising apertures in said housing and said holder communicating with each other and with said reservoir and opened and closed by said valve assembly.

12. The implement of claim 5, wherein said implement is a kitchen brush and said work-engaging medium is a plurality of brush bristles.

13. A fluid-dispensing implement comprising:

a housing defining a fluid reservoir therein, a work-engaging medium carried by the housing, a valve assembly carried by the housing, said valve assembly including an aperture in the housing and a valve member including a plug movable between a closed position for closing the aperture and blocking communication between the reservoir and the medium and an open condition opening the aperture for providing communication between the reservoir and the medium, a leaf spring carried by said housing and engaging said valve member for resiliently biasing said valve member to its closed position, said plug having a knob projecting therefrom, said leaf spring having an aperture therein through which the knob is received, and a lever coupled to said plug and having an end disposed for manual operation by a user, said housing having two spaced apart ledges thereon, said leaf spring having opposed ends respectively disposed beneath said ledges, said spring engaging said valve member intermediate said ends.

14. The implement of claim 13, wherein said valve assembly includes a valve seat on said housing surrounding said aperture and said valve member includes a gasket disposable in sealing engagement with said seat.

* * * * *

UNITED STATES PATENT AND TRADEMARK OFFICE

CERTIFICATE OF CORRECTION

PATENT NO. : 6,250,833 B1
DATED : June 26, 2001
INVENTOR(S) : Perry et al.

It is certified that error appears in the above-identified patent and that said Letters Patent is hereby corrected as shown below:

Column 7,
Line 51, "openable" should be -- operable --.

Signed and Sealed this

Twenty-sixth Day of February, 2002

*Attest:*

*Attesting Officer*

JAMES E. ROGAN
*Director of the United States Patent and Trademark Office*